US006851930B2

(12) United States Patent
Pal

(10) Patent No.: US 6,851,930 B2
(45) Date of Patent: Feb. 8, 2005

(54) NOISE REDUCTION IN AN AIR MOVING APPARATUS

(75) Inventor: Debabrata Pal, Hoffman Estates, IL (US)

(73) Assignee: Motorola, Inc., Schaumburg, IL (US)

( * ) Notice: Subject to any disclaimer, the term of this patent is extended or adjusted under 35 U.S.C. 154(b) by 91 days.

(21) Appl. No.: 10/247,500

(22) Filed: Sep. 19, 2002

(65) Prior Publication Data

US 2004/0057827 A1 Mar. 25, 2004

(51) Int. Cl.[7] ..... F04D 29/66

(52) U.S. Cl. ..... 416/1; 416/500; 416/146 R; 415/119; 415/914; 381/71.3

(58) Field of Search ..... 416/146 R, 229 R, 416/500, 1; 415/119, 914; 381/71.3

(56) References Cited

U.S. PATENT DOCUMENTS 5,636,287 A * 6/1997 Kubli et al. ..... 381/71.2
5,668,744 A * 9/1997 Varadan et al. ..... 700/280
5,791,869 A * 8/1998 Lee ..... 415/119
5,979,593 A * 11/1999 Rice et al. ..... 181/207
6,299,410 B1 * 10/2001 Hilbert et al. ..... 416/145

* cited by examiner

*Primary Examiner*—Ninh H. Nguyen

(57) ABSTRACT

An air moving apparatus for generating cooling airflow is provided that includes a noise reduction system for reducing noise generated by a fan. The air moving apparatus includes a fan having a rotatable hub and a plurality of blades mounted to the hub for rotating about an axis of rotation to provide pressurized airflow. A sensor is situated on a surface of at least one fan blade for sensing airflow characteristics of the air flowing over the fan blade. An actuator, also situated on the surface of the fan blade, changes the characteristic of the airflow over the fan blade in response to the sensed airflow characteristic.

20 Claims, 2 Drawing Sheets

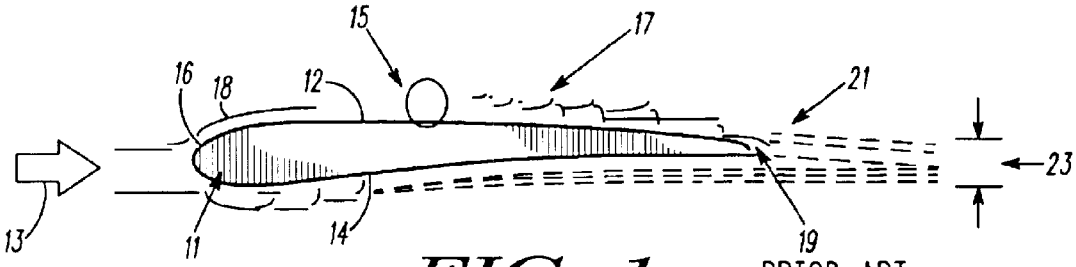
FIG. 1 —PRIOR ART—
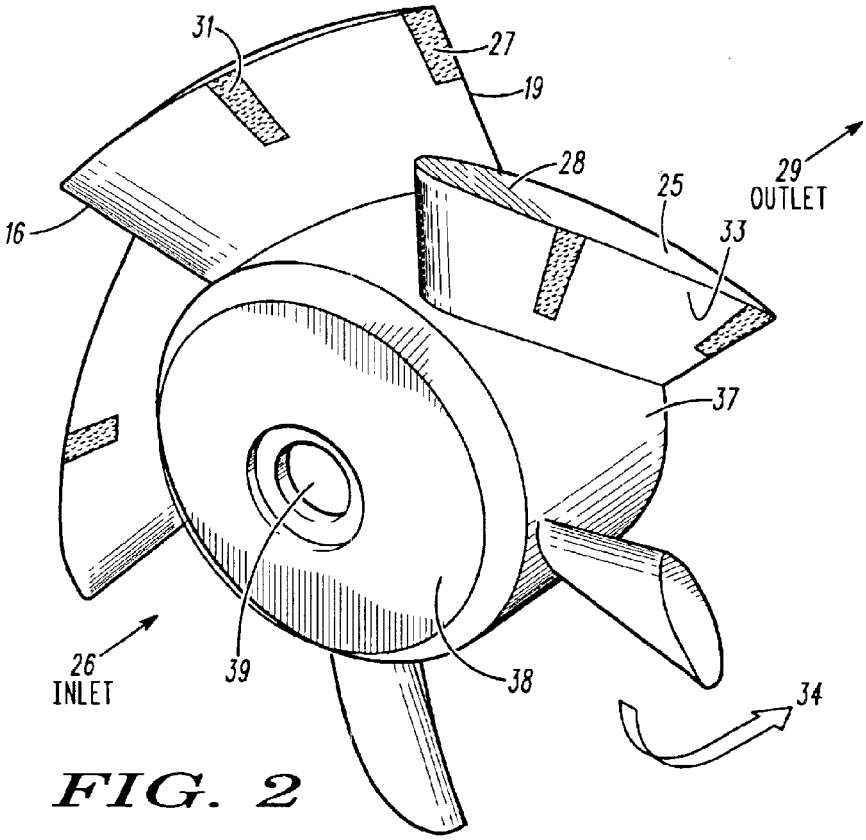
FIG. 2
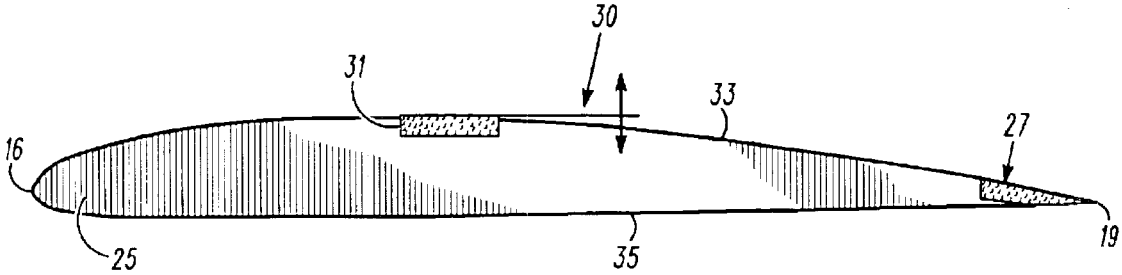
FIG. 3

NOISE REDUCTION IN AN AIR MOVING APPARATUS

FIELD OF THE INVENTION

The present invention relates to an air moving apparatus and, more particularly to fans having low-noise characteristics and a method for actively optimizing such fan characteristics.

BACKGROUND OF THE INVENTION

A wide variety of equipment and systems, such as portable and desktop computers, mainframe computers, communication infrastructure frames, automotive equipment, etc., include heat-generating components in their casings. As increasingly dense and higher performance electronics are packaged into smaller housings, the need for effective cooling systems is paramount to prevent failure of such sensitive electronics devices. One method used to remove heat from such equipment is to have an axial fan draw air from the exterior of the casing to blow cooling air over the heat-generating components. However, as the number of electronics devices in offices and households increase, so too does the number of cooling fans. As such, fan noise becomes significantly loud and undesirable.

Noise reduction in fans generally is accomplished through either active and/or passive noise reduction techniques. In a passive noise reduction system, a fan may include a plurality of projections having a number of predetermined masses that are arranged at positions around the periphery of the blade. This results in creating an unstable mode for the fan. The unstable mode results in disruption of airflow over the blade, thereby resulting in less noise at the trailing edge. However, such a system requires the fan to rotate at a preset rotational speed for maximum effectiveness. Rotation of the fan at other than the preset speed results in decreased effectiveness of the noise reduction methods.

An active noise reduction method includes a fan having a micro electro mechanical system that includes a thin silicon film forming an integrated circuit and an actuator connected to the circuit for generating vibrations. The fan reduces noise by causing the actuator to generate vibration that offsets or reduces unstable airflow along the blade body. However, the operation of the noise reduction system is less than optimal because the actuator and the sensing portion are configured as a closely spaced, or even single, device that is placed at one particular portion of the fan blade. Thus, the actuator and the sensing portion are separated by a negligible distance. As such, the system is unable to simultaneously sense the wake at the trailing edge of the blade and create turbulent flow at a predetermined point along the fan blade.

DESCRIPTION OF THE DRAWINGS

FIG. 1 is a side view of an airfoil illustrating the principles of vortex shedding;

FIG. 2 is a perspective view of a fan having noise reduction capabilities in accordance with the invention;

FIG. 3 is a side view of a fan blade of the fan of FIG. 2 having a sensor and actuator mounted thereon in accordance with the invention;

DETAILED DESCRIPTION

Figure 4:
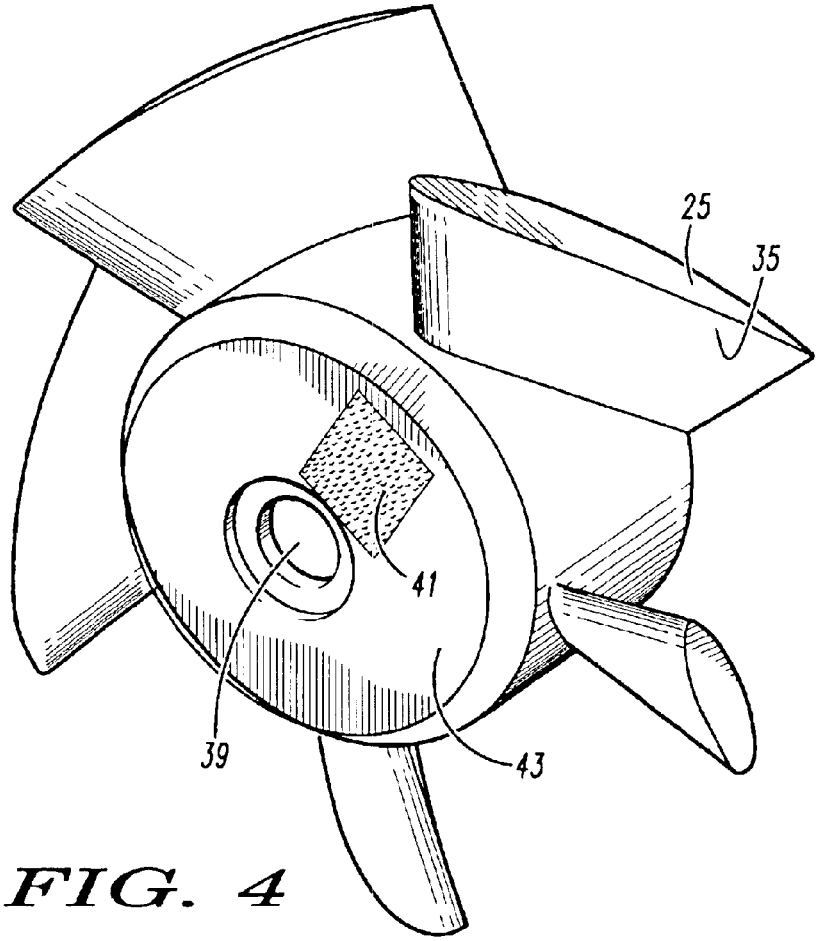
FIG. 4 is a perspective view of the back side of the fan of FIG. 2 having a controller mounted thereon in accordance with the invention.

A known problem with axial fans relates to vortex shedding, which is the principle contributor of aero-acoustic noise in fan operation. Referring to FIG. 1, the mechanism of vortex shedding is shown. In a fan the direction of airflow 13 is partly over the surface of an axial fan blade 11 from the leading edge 16 to the trailing edge 19 of the airfoil of a pressure gradient. At the leading edge 16 of the airfoil and up to a certain distance along the blade 11, the flow of air is laminar 18. That is, there is smooth, uninterrupted flow of air over the surface contour 12 of the fan blade 11. This air flow forms a boundary layer since the air flow has zero velocity right at the surface, and some distance out from the surface it flows at the same velocity as the local outside flow. If the boundary layer flows in parallel layers, with no energy transfer between layers, it is laminar. If there is energy transfer, airflow is no longer laminar, but turbulent 17. All boundary layers start off as laminar. However, due to adverse pressure gradient surface roughness and other destabilizing influences, the airflow 13 begins to separate from the surface 12 of the airfoil blade 11 after a certain distance along the length of the airfoil blade 11. As a result, the pressure and flow becomes more mixed and turbulent, with an increase in the radial or drag direction. The point at which the airflow becomes turbulent is known as a transition regime 15.

As air flows past the trailing edge 19 of the blade 11, it generates a wake 23 behind the blade 11. This is caused by the pressure gradient being in the opposite direction to the airflow. Therefore an eddy or air vortex 21 is created behind the trailing edge of the fan. A similar effect takes place with the airflow around the bottom side 14 of the fan blade 11. These air vortices drop off the back of the fan blade creating the wake 23 behind the blade. This effect is known as vortex shedding. Vortex shedding 21 in this wake region 23 causes pressure fluctuation resulting in generation of acoustic waves and other unwanted vibration. These acoustic waves create noise when the fan is operating.

Referring to FIG. 2, there is illustrated an air moving apparatus in the form of a tube-axial fan 37 in accordance with the present invention having increased noise reduction capabilities via the provided sensors 27 operating in concert with actuators 31 on the fan blade 25 of the fan 37. The frequency of the oscillation of the actuator 31 for decreasing fan noise is dynamically determined from acoustic input received by the sensor 27 and actively adjusted by a controller 41 (FIG. 4) as desired for quiet operation. In this manner, the present fan 37 is particularly effective in those applications where the fan noise may be excessive, i.e. small casings enclosing high-density consumer electronics therein.

The fan 37 includes a plurality of fan blades 25 extending generally radially outward from a hub 38. Each fan blade 25 terminates at a tip end portion 28 thereof radially spaced from the hub 38 and has a leading edge 16 and a trailing edge 19 extending between the hub 38 and the tip end portion 28. The fan is rotatively driven by an output shaft of a motor (not shown) that engages the center 39 of the hub 38. The motor rotates the fan 37 about a central longitudinal axis that is defined by the receiving portion 39 of the fan 37. This causes the fan blades 25 to draw air from an inlet side 26 of the fan 37 and to impart velocity to discharge the air from an outlet side 29 in the direction generally indicated by arrow 34.

Turning to FIG. 3, the fan blade 25 of the fan 37 in accordance with the present invention is shown in greater detail. The fan blade 25 has a bottom side 35 and a top side 33. The top side 33 has mounted thereon a piezoelectric sensor element 27 made of thin organic polymer such as polyvinylidene fluoride (PVDF) or lead zirconate titanate (PZT). Using, for example, the PVDF piezoelectric sensor element 27 on the trailing edge 19 of the fan blade provides several significant advantages over sensors made of thin film silicon or the like. For example, the PVDF sensor material is an inexpensive thin plastic polymer sheet or film that has a thin electrically conductive nickel copper alloy deposited on each side. Electrical connections are made to the film using wires that may be attached to the conductive coating of the film using copper tape or conductive epoxy. The film itself may be cut to shape as needed and glued onto the appropriate location on the fan blade 25. Thus, the advantages of using the PVDF sensor include its low cost and the ease in which the sensor may be configured for use in a variety of fan blade sizes.

The sensor element 27 is attached on the trailing edge of the blade and senses pressure fluctuation and acoustic energy at the trailing edge of the blade 25. Fluctuations in air pressure are detected by the sensor 27 when air pressure or sound waves, such as acoustical waves, cause the film to stretch and conduct electricity, thereby creating a closed circuit between the wires. The system of the present invention detects the closing and opening of the circuit to determine characteristics of the waves at the trailing edge of the blade 25. Thus, the sensor is able to determine the presence of noise causing air waves.

The top side of the fan blade 25 also has mounted thereon an actuator 31 made of piezoelectric element and a thin layer or fin 30 attached on the top surface. The actuator 31, being also made of piezoelectric film, is made to vibrate, which in turn causes the fin 30 to vibrate as well. Applying and removing voltage to the fin 30 causes the material to bend and then return to its original shape, thereby creating a vibration motion. Alternatively, two sheets of film maybe joined together to form a bimorph. The sheets are arranged such that when voltage is applied to the bimorph, one film laminate lengthens while the other contracts. Voltage of the reverse polarity causes the bimorph to bend in the other direction. Thus, the vibration rate of the actuator is controlled in the first case by pulsing power to the film or in the second case by reversing the polarity of the voltage being supplied to the bimorph.

As shown, the sensor element 27 and actuator 29 are purposefully spaced apart. An advantage of such a configuration is the ability to detect noise in the area of the fan where most noise originates, i.e. the trailing edge, and to correct or eliminate the conditions that lead to the noise by creating turbulence in the laminar flow region. As such, fan noise caused by vortex shedding is reduced through the elimination of the shedding of vortices by deliberately converting laminar flow to turbulent flow.

Figure 5:
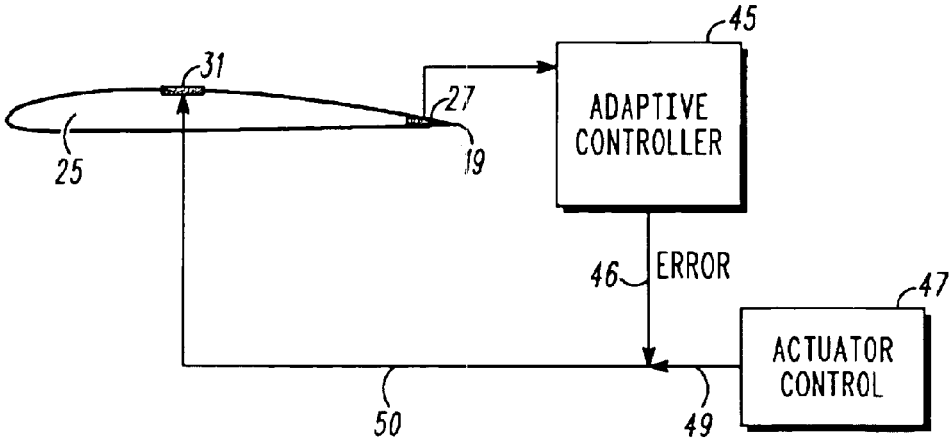
FIG. 5 is a flow diagram of the controller in operation in accordance with the invention.

Referring to FIGS. 4 and 5, a controller 41 comprising a feedback control loop is shown mounted on the hub 43 on the reverse side of the fan 25. The controller hardware may comprise a 16 bit analog-to-digital/digital-to-analog converter (ADC/DAC), such as the TMC320C62 digital signal processor (DSP), available from Texas Instruments Corporation.

The controller 41 includes an adaptive controller 45 and an actuator controller 47 that is used for exciting the actuator by pulsing the voltage or controlling the voltage polarity. The feedback control loop of the controller 41 is mounted on the hub 43 of the fan 25 and receives power and signal from the rotating shaft of the fan. During operation of the fan 37, the airflow over the fan blade 25 is laminar near the leading edge 16, and changes to transition regime downstream. The transition of boundary lair from laminar regime occurs generally on the suction side (upper side) 33 of the airfoil blade 25. Based on the acoustic feedback from the sensor 27 at the trailing edge, the actuator controller 47 causes excitation of the boundary layer at a particular predetermined frequency using the piezoelectric actuator 31 to vibrate the fin 30 at the appropriate frequency as determined by the adaptive controller 45. Thus, the laminar airflow is converted to turbulent flow deliberately. Accordingly, the problems of noise associated with the transition to turbulent flow and subsequent vortex generation is reduced.

Continuing to refer to FIG. 5, the control loop is shown in operation. As discussed above, the acoustic wave emitted from the blade 25 has a particular frequency spectrum. The sound pressure level at the trailing edge 27 is a function of the aerodynamic loading, speed, and the inlet turbulence level. The frequency spectrum also changes in a similar manner. Based on the acoustic input at the sensor 27, the control circuit 41 (FIG. 4) determines the required frequency of the piezoelectric actuator 31. In particular, the control loop determines the sound pressure level versus the frequency data from the sensor 27 input in narrow band over a period of time. The control loop then scales the data using a preset scale, such as A scale, of acoustic averaging. From the scaled sound pressure data, the control loop determines the objectional frequency peaks, such as 1000 Hz, or any other objectionable frequency in the audible range of human bearing.

The piezoelectric actuator 31 causes vibration on one end of the fin 30. The fin 30 vibrates, generating pressure fluctuation on the surface of the airfoil blade 25. The pressure fluctuation results in breakup of the attached laminar flow. This causes the laminar flow to transition to turbulent flow early and before reaching the trailing edge 19, resulting in reduced or eliminated vortex shedding and correspondingly lowered noise levels. The amount of vibration required of the fin is adaptively determined by the controller 41. In particular, the feedback control loop of the controller 41 determines frequency windows for generating correction signals. Depending on the level of turbulence generated the acoustic wave radiation at the trailing edge 19 changes.

Based on the change of the acoustic wave radiation sensed by the piezoelectric sensor 27, a control signal modifier or error signal 46 is generated. The generated error signal 46 is combined with the predefined actuator signal 49 to send a corrected signal 50 to the actuator 31. The actuator control in the feedback loop creates the voltage signal to the actuator 31. The resultant acoustic signal from this correction is again received from the sensor 31 and the above process is repeated until cancellations of the objectionable sound pressure peaks are eliminated. Thus, an active control loop is established. Accordingly, the control circuit automatically and dynamically establishes the appropriate signal for the actuator depending in the change in loading or any other parameter changes.

While there have been illustrated and described particular embodiments of the present invention, it will be appreciated that numerous changes and modifications will occur to those skilled in the art, and it intended in the impendent claims to cover all those changes and modifications that fall within the true spirit and scope of the present invention.

What is claimed is:

1. In an air moving apparatus for generating cooling air flow, a noise reduction system comprising:

a fan having a rotatable hub and plurality of blades mounted to the hub for rotating about an axis of rotation to provide pressurized airflow each of the blades having a trailing edge and a leading edge;

a sensor of at least one fan blade positioned for sensing a wake at the trailing edge of the one fan blade; and an actuator between the leading and trailing edge of the one fan blade and spaced from the sensor to generate turbulent airflow over the fan blade at a position where airflow is otherwise laminar in response to the sensed wake at the trailing edge.

2. The noise reduction system of claim 1, further comprising a controller for receiving data from the sensor and enabling the actuator to vibrate at a frequency based on the received sensor data.

3. The noise reduction system of claim 1, wherein the sensor is a piezoelectric sensor.

4. The noise reduction system of claim 3, wherein the piezoelectric sensor is located on the trailing edge of the fan blade for sensing pressure fluctuation at the trailing edge.

5. The noise reduction system of claim 3, wherein the piezoelectric sensor is located on the trailing edge of the fan blade and senses acoustic energy at the trailing edge.

6. The noise reduction system of claim 1, wherein the actuator is a piezoelectric element with an attached thin layer fin.

7. In an air moving apparatus for generating cooling air flow, a noise reduction system comprising:

a fan having a rotatable hub and plurality of blades mounted to the hub for rotating about an axis of rotation to provide pressurized airflow;

a sensor situated on a surface of at least one fan blade for sensing at least one characteristic of airflow over the fan blade; and an actuator situated on the surface of the fan blade for changing the characteristic of airflow over the fan blade in response to the sensed airflow characteristic, wherein the vibration frequency of the actuator is determined using data provided by the sensor to convert laminar airflow to turbulent airflow for reducing vortex shedding, the actuator enabling the fin to vibrate at a predetermined frequency to cause laminar air flow to become turbulent air flow before reaching a trailing edge of the fan blade.

8. A method for reducing noise in an air moving apparatus, comprising the steps of:

generating pressurized airflow using one or more fan blades;

sensing at least one characteristic of the airflow at a trailing edge of one of the fan blades; and changing the characteristic of the airflow upstream of the trailing edge in response to the sensed airflow characteristic at the one fan blade trailing edge.

9. The method of claim 8 wherein the sensing step further comprises the step of sensing with a piezoelectric sensor the acoustic energy at the trailing edge of the fan blade.

10. The method of claim 8 wherein the sensing step further comprises the step of sensing with a piezoelectric sensor the pressure fluctuation at the trailing edge of the fan blade.

11. A method for reducing noise in an air moving apparatus, comprising the steps of:

generating pressurized airflow using one or more fan blades;

sensing at least one characteristic of the airflow as it travels over the fan blade at a sensing location; and changing the characteristic of the airflow in response to the sensed airflow characteristic, wherein the characteristic changing step further comprises the step of converting laminar air flow to turbulent air flow to prevent vortex shedding on the trailing edge of the fan blade.

12. The method of claim 11 wherein the converting step further comprises the step of vibrating a piezoelectric actuator at a predetermined frequency at a predetermined location on the fan blade.

13. The method of claim 12 wherein the converting step further comprises generating a control signal specifying the rate of vibration of the piezoelectric actuator.

14. The method of claim 13 further comprising the step of creating a feedback control loop to dynamically control the frequency rate of the piezoelectric actuator.

15. The method of claim 14 wherein the feedback control loop creating step further comprises the steps of generating a control signal modifier based on the sensed characteristic and combining the control signal modifier with the control signal to dynamically create a new control signal specifying the rate of vibration of the piezoelectric actuator.

16. The method of claim 12 further comprising the step of calculating the rate of the frequency based on the sensed airflow characteristic.

17. A noise reduction system for an air moving apparatus comprising:

means for generating pressurized airflow including a plurality of blades each having a trailing edge and a leading edge;

means for sensing at least one characteristic of the airflow over at least one of the blades, the sensing means located on the generating means; and means for changing a second characteristic of the airflow over the one fan blade in response to the sensed airflow characteristic, the changing means located on the generating means spaced from the sensing means, wherein the changing means changes the second characteristic of airflow to the one characteristic of airflow to reduce noise created by operation of the generating means.

18. The noise reduction system of claim 17 further comprising means for calculating operating parameters and controlling operation of the dynamically varying means based on the calculated operating parameters.

19. A noise reduction system for an air moving apparatus comprising; means for generating pressurized airflow;

means for sensing at least one characteristic of the airflow over the generating means, the sensing means located on the generating means; and means for changing the characteristic of the airflow over the fan blade in response to the sensed airflow characteristic, the changing means located on the generating means, the sensing means located at a significant distance from the change means, wherein the characteristic changing means comprises means for converting laminar airflow over the pressurized airflow generating means into turbulent airflow.

20. The noise reduction system of claim 19 further comprising means for dynamically varying the operation of the converting means in response to the sensed airflow characteristics.

* * * * *